US012514412B2

(12) United States Patent
Yang

(10) Patent No.: US 12,514,412 B2
(45) Date of Patent: Jan. 6, 2026

(54) KID-SIZED TOILET FEATURING SMALL STORAGE SPACE

(71) Applicant: TJ(fujian) Industrial Co., Ltd., Zhangzhou (CN)

(72) Inventor: Jianbo Yang, Zhangzhou (CN)

(73) Assignee: TJ(fujian) Industrial Co., Ltd., Zhangzhou (CN)

( * ) Notice: Subject to any disclaimer, the term of this patent is extended or adjusted under 35 U.S.C. 154(b) by 99 days.

(21) Appl. No.: 18/635,052

(22) Filed: Apr. 15, 2024

(65) Prior Publication Data

US 2024/0341546 A1 Oct. 17, 2024

(30) Foreign Application Priority Data

Apr. 17, 2023 (CN) ..... 202320847211.3

(51) Int. Cl.
*A47K 11/04* (2006.01)

(52) U.S. Cl.
CPC ..... *A47K 11/04* (2013.01)

(58) Field of Classification Search
CPC ..... A47K 11/04; A47K 11/06
USPC ..... 4/483
See application file for complete search history.

(56) References Cited

U.S. PATENT DOCUMENTS

| | | | | |
|---|---|---|---|---|
| 11,330,942 | B1 * | 5/2022 | Bergman | A47K 11/04 |
| 11,793,369 | B1 * | 10/2023 | Yang | A47K 11/04 |
| D1,015,498 | S * | 2/2024 | Sultan | D23/296 |
| D1,063,016 | S * | 2/2025 | Chen | D23/296 |
| 2022/0183517 | A1 * | 6/2022 | Yang | A47K 11/04 |
| 2025/0169660 | A1 * | 5/2025 | Liu | A47K 11/06 |

* cited by examiner

*Primary Examiner* — Huyen D Le
(74) *Attorney, Agent, or Firm* — Bayramoglu Law Offices LLC

(57) ABSTRACT

A kid-sized toilet featuring a small storage space is provided. The kid-sized toilet includes a toilet base, a top lid, and a toilet tank-imitated container, where a top surface of the toilet base is provided with a first accommodating chamber that extends downwards; a front part of the top lid is provided with a second accommodating chamber with an open top surface; the top lid is connected to the top surface of the toilet base; the second accommodating chamber is located inside the first accommodating chamber, and is provided with a bowl that is compatible with the second accommodating chamber; a rear part of the top surface of the top lid is provided with a protruding part; the toilet tank-imitated container is a hollow structure with a bottom opening; and the bottom opening of the toilet tank-imitated container is compatible with the protruding part.

8 Claims, 6 Drawing Sheets

KID-SIZED TOILET FEATURING SMALL STORAGE SPACE

CROSS REFERENCE TO THE RELATED APPLICATIONS

This application is based upon and claims priority to Chinese Patent Application No. 202320847211.3, filed on Apr. 17, 2023, the entire contents of which are incorporated herein by reference.

TECHNICAL FIELD

The present disclosure relates to the field of children's toilets, and in particular to a kid-sized toilet featuring a small storage space.

BACKGROUND

The children's toilet provides a great convenience for children to use the toilet. As a type of children's toilet, the kid-sized toilet allows children to sit on the toilet to use the toilet. Currently, the kid-sized toilet on the market includes a toilet body. The rear part of the top surface of the toilet body is provided with a toilet tank-imitated container. During packaging and storage, the toilet tank-imitated container and the toilet body are connected together, resulting in a large space occupied by the kid-sized toilet and thereby leading to an unnecessary waste of space. In view of this, the present disclosure is proposed through careful research.

SUMMARY

The present disclosure provides a kid-sized toilet featuring a small storage space, mainly aimed at solving the problem of large space occupied by the existing kid-sized toilet during packaging and storage.

To solve the above technical problem, the present disclosure adopts the following technical solution.

A kid-sized toilet featuring a small storage space includes a toilet base, a top lid, and a toilet tank-imitated container, where a top surface of the toilet base is provided with a first accommodating chamber that extends downwards; a front part of the top lid is provided with a second accommodating chamber with an open top surface; the top lid is connected to the top surface of the toilet base; the second accommodating chamber is located inside the first accommodating chamber, and is provided with a bowl that is compatible with the second accommodating chamber; a top part of the bowl is clamped at a top surface of the top lid; a rear part of the top surface of the top lid is provided with a protruding part; the toilet tank-imitated container is a hollow structure with a bottom opening; the bottom opening of the toilet tank-imitated container is compatible with the protruding part; the toilet tank-imitated container is provided at the rear part of the top surface of the top lid; the protruding part is located in the bottom opening of the toilet tank-imitated container, and is clamped with the toilet tank-imitated container; a rear part of the toilet base is provided with an accommodating part; a bottom surface of the accommodating part is provided with a third accommodating chamber that extends upwards and is compatible with the toilet tank-imitated container; and the top surface of the top lid is provided with a toilet seat and a toilet lid that are hinged to the top lid.

Further, an inner peripheral surface of a bottom part of the toilet tank-imitated container is provided with multiple clamping parts; the clamping parts each are provided with a first inclined surface; an outer periphery of the protruding part is provided with multiple clamping slots; the clamping slots each correspond to one clamping part; and a top surface of the clamping slot is provided with a second inclined surface that is fit with the first inclined surface.

Further, a top part of the toilet tank-imitated container is provided with a cover opening; the cover opening is provided with a toilet tank-imitated container cover; the toilet tank-imitated container cover therein is provided with a player and a control circuit board; the top part of the toilet tank-imitated container cover is further provided with a button; an outer periphery of the button is provided with a light ring; and the button and the light ring are connected to the control circuit board.

Further, left and right ends of the top part of the toilet tank-imitated container are provided with are grooves.

Further, a rear surface of the toilet tank-imitated container is provided with a tissue port.

Further, a front end of the bowl is provided with a grip part that protrudes upwards; a bottom surface of a front end of the grip part is an arc surface that protrudes upwards; a front end of the toilet seat is provided with a protrusion that is compatible with the grip part; and the grip part is located inside the protrusion.

Further, a top surface of the toilet seat gradually tilts downwards from outside to inside.

Further, except the accommodating part, the toilet base is divided into an upper toilet base part and a lower toilet base part; a width of the upper toilet base part gradually decreases in a circular arc from top to bottom, while a width of the lower toilet base part gradually increases in a circular arc from top to bottom; the upper toilet base part and the lower toilet base part are connected through a transitional arc surface; and a maximum width of the lower toilet base part is greater than a maximum width of the upper toilet base part.

According to the description of the present disclosure, compared with the prior art, the present disclosure has the following advantages. The present disclosure has a novel structure and clever design. The toilet tank-imitated container is directly provided on the top lid. The protruding part on the top lid is located at the bottom part of the toilet tank-imitated container, and the toilet tank-imitated container is clamped with the protruding part to prevent the toilet tank-imitated container from falling. During packaging or storing, the toilet tank-imitated container is provided in the third accommodating chamber. The toilet tank-imitated container is perfectly integrated with the toilet base for storage, thereby reducing the overall height of the kid-sized toilet. Especially during packaging, the design reduces the packaging volume and makes the kid-sized toilet compact, making the kid-sized toilet portable. To assemble the kid-sized toilet, the toilet tank-imitated container is clamped with the protruding part.

DETAILED DESCRIPTION OF THE EMBODIMENTS

Figure 1:
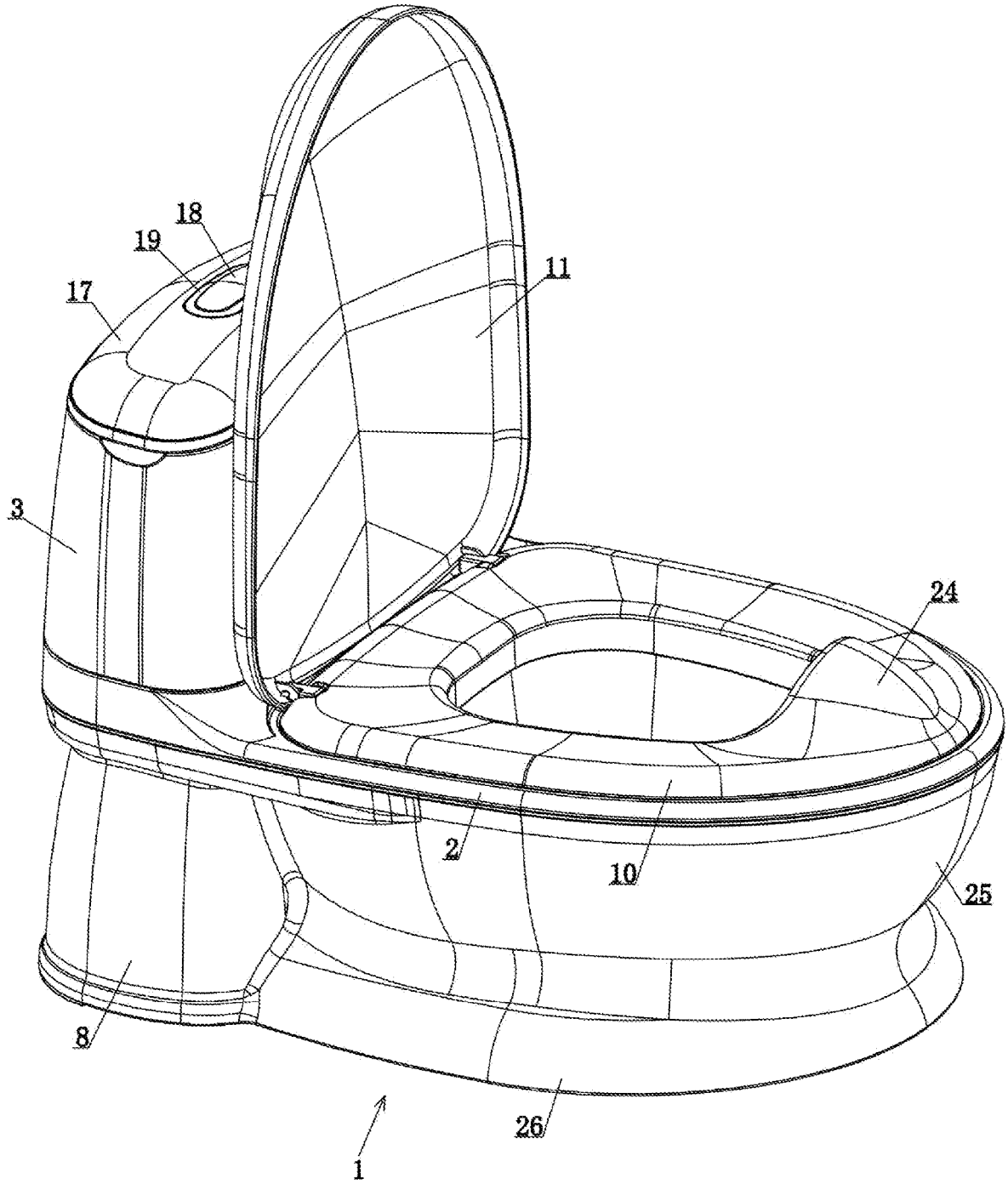
FIG. 1 is a structural diagram of a kid-sized toilet featuring a small storage space according to the present disclosure.

Referring to FIGS. 1 to 4, a kid-sized toilet featuring a small storage space includes toilet base 1, top lid 2, and toilet tank-imitated container 3. A top surface of the toilet base 1 is provided with first accommodating chamber 4 that extends downwards. A front part of the top lid 2 is provided with second accommodating chamber 5 with an open top surface. The top lid 2 is connected to the top surface of the toilet base 1. The second accommodating chamber 5 is located inside the first accommodating chamber 4. The second accommodating chamber 5 is provided with bowl 6 that is compatible with the second accommodating chamber. A top part of the bowl 6 is clamped at a top surface of the top lid 2. A rear part of the top surface of the top lid 2 is provided with protruding part 7. The toilet tank-imitated container 3 is a hollow structure with a bottom opening. The bottom opening of the toilet tank-imitated container 3 is compatible with the protruding part 7. The toilet tank-imitated container 3 is provided at the rear part of the top surface of the top lid 2. The protruding part 7 is located in the bottom opening of the toilet tank-imitated container 3, and is clamped with the toilet tank-imitated container 3. A rear part of the toilet base 1 is provided with accommodating part 8. A bottom surface of the accommodating part 8 is provided with third accommodating chamber 9 that extends upwards and is compatible with the toilet tank-imitated container 3. The top surface of the top lid 2 is provided with toilet seat 10 and toilet lid 11 that are hinged to the top lid 2. The toilet seat 10 and the toilet lid 11 are hinged to the top lid 2 through a method that is a prior art and will not be repeated herein.

Referring to FIGS. 1, 2, 4, and 5, an inner peripheral surface of a bottom part of the toilet tank-imitated container 3 is provided with multiple clamping parts 12. The clamping parts 12 each are provided with first inclined surface 13. An outer periphery of the protruding part 7 is provided with multiple clamping slots 14. The clamping slots 14 each correspond to one clamping part 12. A top surface of the clamping slot 14 is provided with second inclined surface 15 that is fit with the first inclined surface 13. When the toilet tank-imitated container 3 is connected to the protruding part 7, the bottom opening of the toilet tank-imitated container 3 faces the protruding part, and each clamping part 12 faces the corresponding clamping slot 14. The toilet tank-imitated container 3 is pressed down to make the clamping part 12 snap into the corresponding clamping slot 14. After the clamping part 12 is inserted into the corresponding clamping slot 14, the top surface of the clamping part 12 is abutted against the top surface of the clamping slot 14. Through the first inclined surface 13 and the second inclined surface 15, the clamping part 12 can smoothly enter the clamping slot 14.

Figure 2:
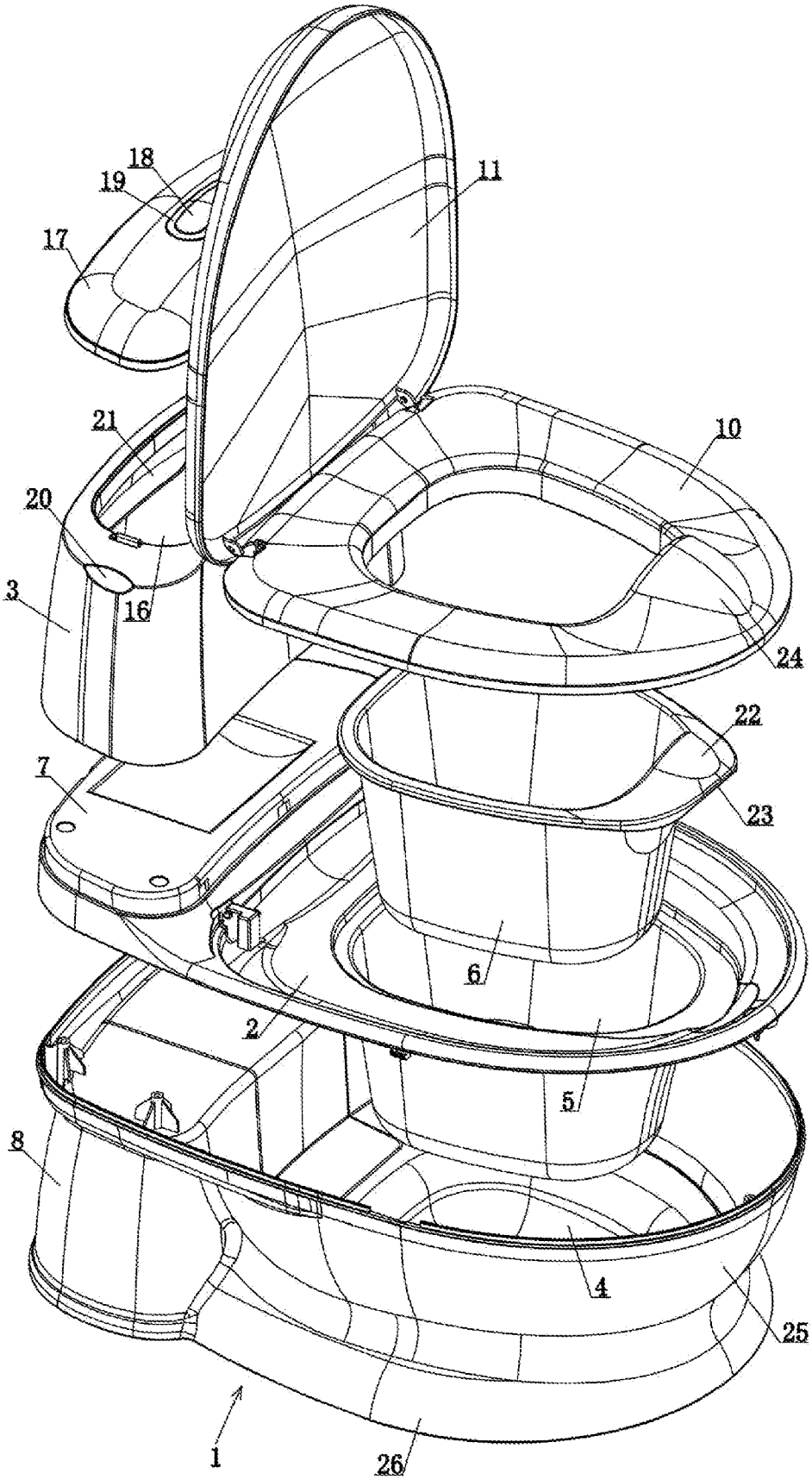
FIG. 2 is an exploded view of the kid-sized toilet featuring a small storage space according to the present disclosure.
Figure 3:
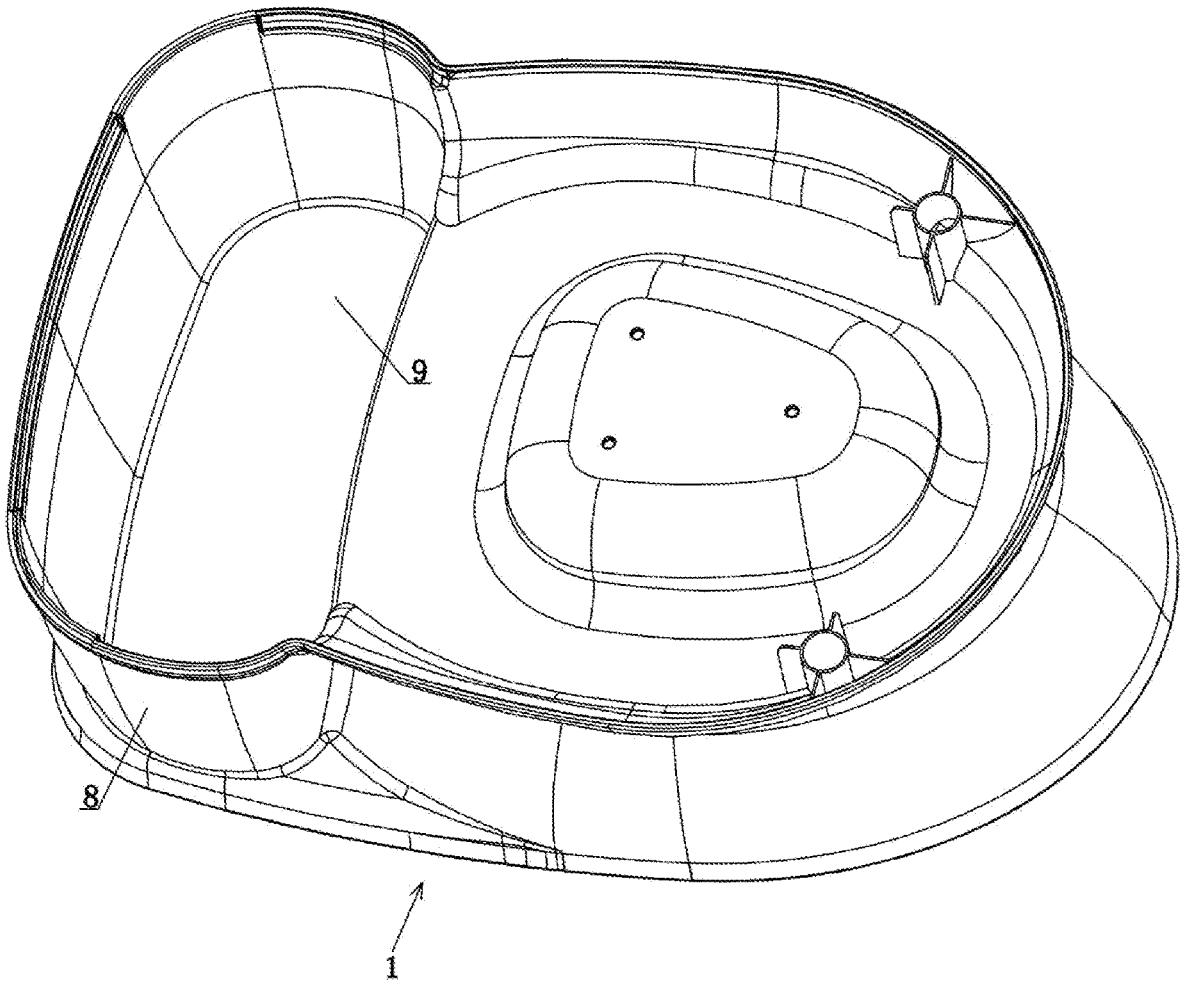
FIG. 3 is a structural diagram of a toilet base of the kid-sized toilet featuring a small storage space according to the present disclosure.
Figure 4:
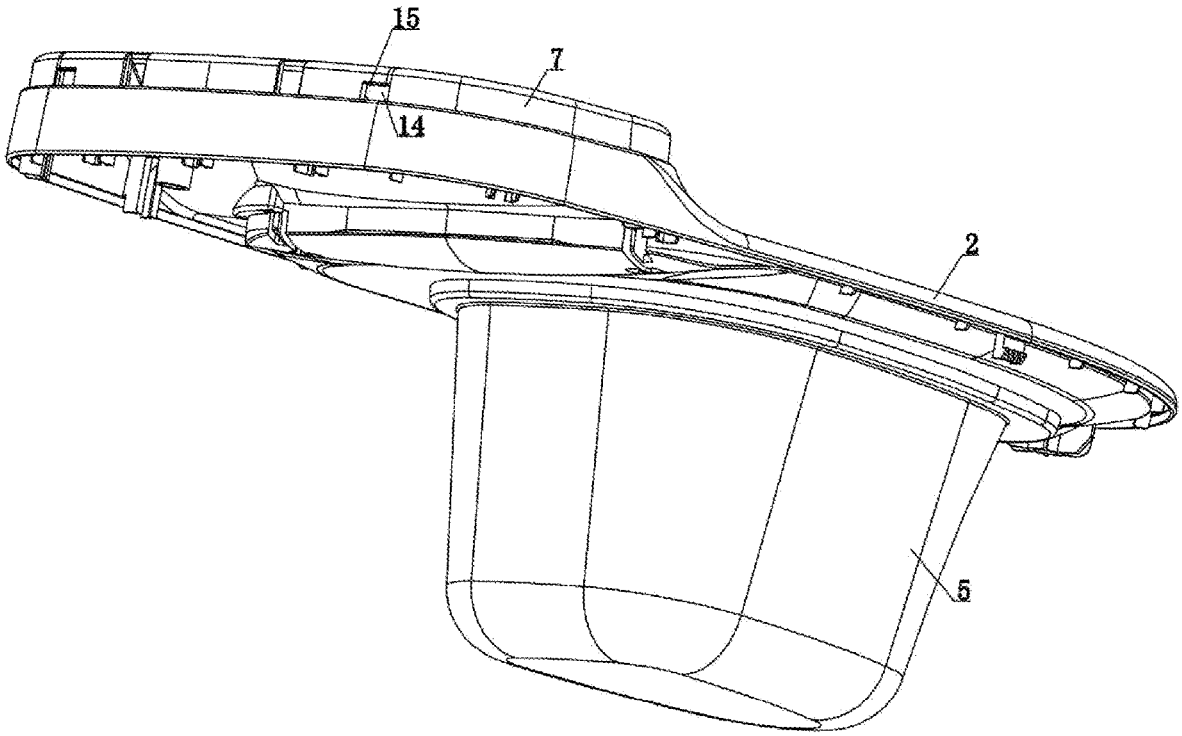
FIG. 4 is a structural diagram of a top lid of the kid-sized toilet featuring a small storage space according to the present disclosure.
Figure 5:
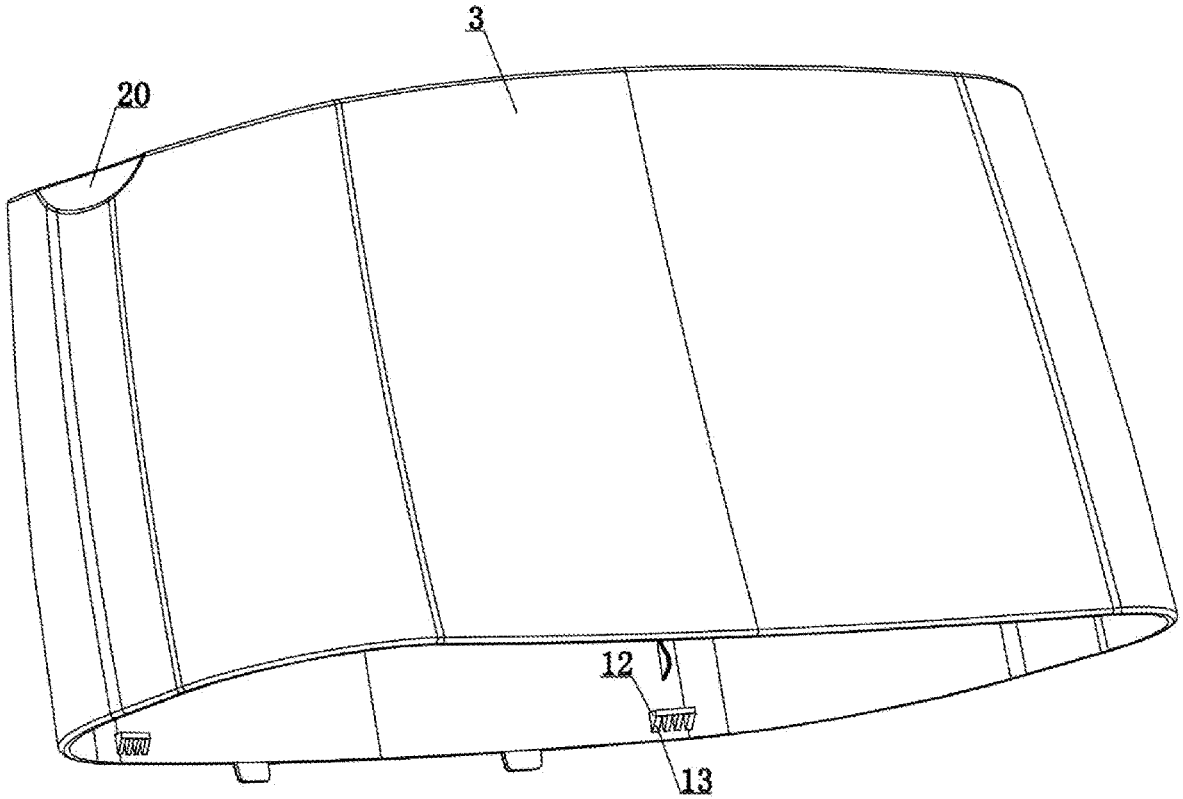
FIG. 5 is a structural diagram of a toilet tank-imitated container of the kid-sized toilet featuring a small storage space according to the present disclosure.
Figure 6:
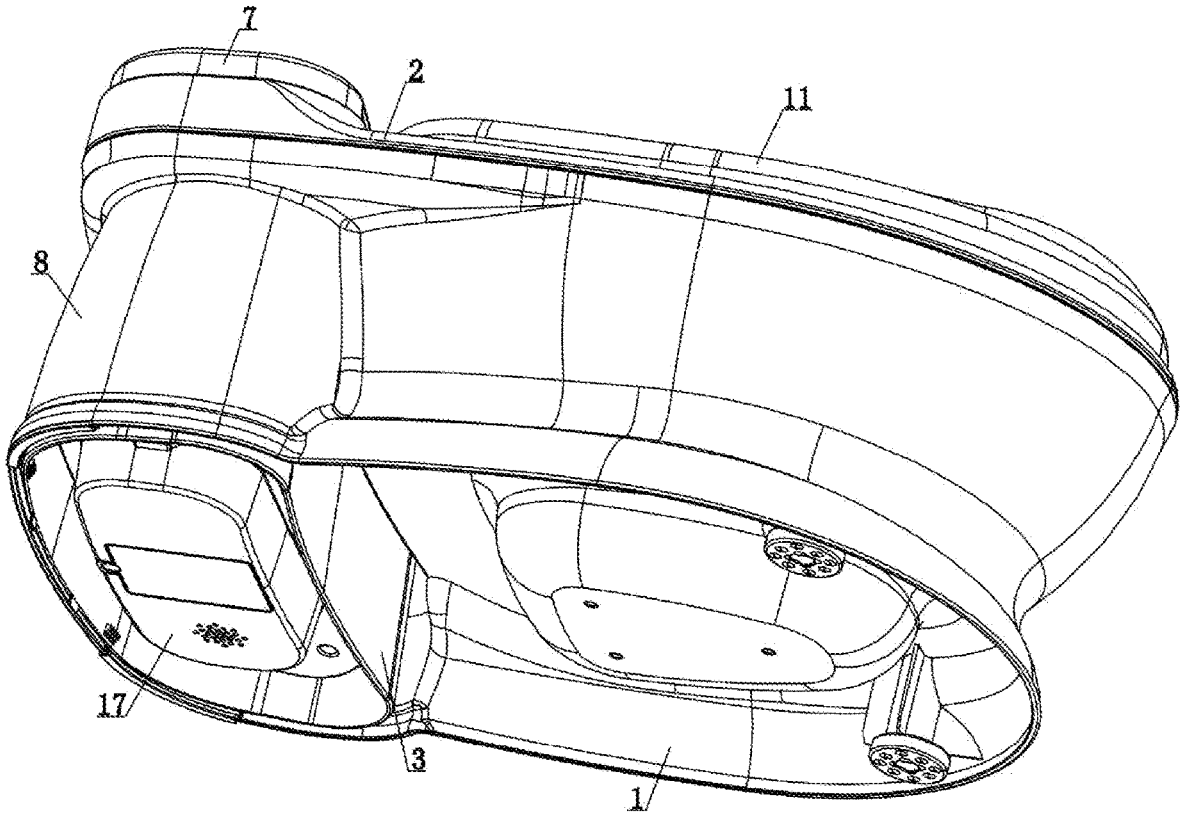
FIG. 6 is a structural diagram of the kid-sized toilet featuring a small storage space in a storage state according to the present disclosure.

Referring to FIGS. 1 and 2, a top part of the toilet tank-imitated container 3 is provided with cover opening 16. The cover opening 16 is provided with toilet tank-imitated container cover 17. The toilet tank-imitated container cover 17 therein is provided with a player (not shown in the figure) and a control circuit board (not shown in the figure). The top part of the toilet tank-imitated container cover 17 is further provided with button 18. An outer periphery of the button 18 is provided with light ring 19. The button 18 and the light ring 19 are connected to the control circuit board (not shown in the figure). When the button 18 is pressed down, the control circuit board (not shown in the figure) controls the player (not shown in the figure) to play a sound like flushing water, and the light ring 19 lights up. Left and right ends of the top part of the toilet tank-imitated container 3 are provided with arc grooves 20. The arc grooves 20 are convenient for hands to take the toilet tank-imitated container cover 17. A rear surface of the toilet tank-imitated container 3 is provided with tissue port 21. A top surface of the protruding part 7 can be configured to place packaged or boxed tissues, and the tissues can be taken from the tissue port 21. Therefore, parents do not need to carry the tissues through other device.

Referring to FIGS. 1 and 2, a front end of the bowl 6 is provided with grip part 22 that protrudes upwards. A bottom surface of a front end of the grip part 22 is arc surface 23 that protrudes upwards. A front end of the toilet seat 10 is provided with protrusion 24 that is compatible with the grip part 22. The grip part 22 is located inside the protrusion 24. The grip part 22 facilitates parents to take out the bowl 6 for cleaning. The arc surface 23 provides a space for the hand to grip. The protrusion 24 provides an accommodating space for the grip part 22, and also prevents a boy from urinating outside the toilet when using the toilet. A top surface of the toilet seat 10 gradually tilts downwards from outside to inside. The toilet seat 10 adopts a downwardly recessed design that conforms to ergonomics, and adopts the shape of a dynamic water motorboat. The toilet seat 10 is made of polypropylene (PP).

Referring to FIGS. 1 and 2, except the accommodating part 8, the toilet base 1 is divided into upper toilet base part 25 and lower toilet base part 26. A width of the upper toilet base part 25 gradually decreases in a circular arc from top to bottom, while a width of the lower toilet base part 26 gradually increases in a circular arc from top to bottom. The upper toilet base part 25 and the lower toilet base part 26 are connected through a transitional arc surface. A maximum width of the lower toilet base part 26 is greater than a maximum width of the upper toilet base part 25. Through the shape design of the toilet base 1, the bottom part of the toilet base 1 is stable, and the kid is less likely to roll over when using the toilet.

Referring to FIGS. 1 to 6, the design principle of the present disclosure is as follows. The toilet tank-imitated container 3 is directly provided on the top lid 2. The protruding part 7 on the top lid 2 is located at the bottom part of the toilet tank-imitated container 3, and the toilet tank-imitated container 3 is clamped with the protruding part 7 to prevent the toilet tank-imitated container 3 from falling. During packaging or storing, the toilet tank-imitated container 3 is provided in the third accommodating chamber 9, and the toilet tank-imitated container cover 17 is provided in the toilet tank-imitated container 3. The toilet tank-imitated container 3 is perfectly integrated with the toilet base for storage, thereby reducing the overall height of the kid-sized toilet. Especially during packaging, the design reduces the packaging volume and makes the kid-sized toilet compact. To assemble the kid-sized toilet, the toilet tank-imitated container 3 is clamped with the protruding part 7.

The above described are merely specific implementations of the present disclosure, but the design concept of the present disclosure is not limited thereto. Any non-substantial changes made to the present disclosure based on the concept of the present disclosure should fall within the protection scope of the present disclosure.

What is claimed is:

1. A kid-sized toilet featuring a small storage space, comprising a toilet base, a top lid, and a toilet tank-imitated container, wherein a top surface of the toilet base is provided with a first accommodating chamber, wherein the first accommodating chamber extends downwards;

a front part of the top lid is provided with a second accommodating chamber with an open top surface;

the top lid is connected to the top surface of the toilet base;

the second accommodating chamber is located inside the first accommodating chamber, and is provided with a bowl, wherein the bowl is compatible with the second accommodating chamber;

a top part of the bowl is clamped at a top surface of the top lid;

a rear part of the top surface of the top lid is provided with a protruding part;

the toilet tank-imitated container is a hollow structure with a bottom opening;

the bottom opening of the toilet tank-imitated container is compatible with the protruding part;

the toilet tank-imitated container is provided at the rear part of the top surface of the top lid;

the protruding part is located in the bottom opening of the toilet tank-imitated container, and is clamped with the toilet tank-imitated container;

a rear part of the toilet base is provided with an accommodating part;

a bottom surface of the accommodating part is provided with a third accommodating chamber, wherein the third accommodating chamber extends upwards and is compatible with the toilet tank-imitated container; and the top surface of the top lid is provided with a toilet seat and a toilet lid, wherein the toilet seat and the toilet lid are hinged to the top lid.

2. The kid-sized toilet featuring the small storage space according to claim 1, wherein an inner peripheral surface of a bottom part of the toilet tank-imitated container is provided with a plurality of clamping parts; the plurality of clamping parts each are provided with a first inclined surface; an outer periphery of the protruding part is provided with a plurality of clamping slots; the plurality of clamping slots each correspond to one clamping part; and a top surface of the clamping slot is provided with a second inclined surface, wherein the second inclined surface is fit with the first inclined surface.

3. The kid-sized toilet featuring the small storage space according to claim 1, wherein a top part of the toilet tank-imitated container is provided with a cover opening; the cover opening is provided with a toilet tank-imitated container cover; the toilet tank-imitated container cover therein is provided with a player and a control circuit board; the top part of the toilet tank-imitated container cover is further provided with a button; an outer periphery of the button is provided with a light ring; and the button and the light ring are connected to the control circuit board.

4. The kid-sized toilet featuring the small storage space according to claim 3, wherein left and right ends of the top part of the toilet tank-imitated container are provided with arc grooves.

5. The kid-sized toilet featuring the small storage space according to claim 1, wherein a rear surface of the toilet tank-imitated container is provided with a tissue port.

6. The kid-sized toilet featuring the small storage space according to claim 1, wherein a front end of the bowl is provided with a grip part, wherein the grip part protrudes upwards; a bottom surface of a front end of the grip part is an arc surface, wherein the arc surface protrudes upwards; a front end of the toilet seat is provided with a protrusion, wherein the protrusion is compatible with the grip part; and the grip part is located inside the protrusion.

7. The kid-sized toilet featuring the small storage space according to claim 1, wherein a top surface of the toilet seat gradually tilts downwards from outside to inside.

8. The kid-sized toilet featuring the small storage space according to claim 1, wherein except the accommodating part, the toilet base is divided into an upper toilet base part and a lower toilet base part; a width of the upper toilet base part gradually decreases in a circular arc from top to bottom, while a width of the lower toilet base part gradually increases in a circular arc from top to bottom; the upper toilet base part and the lower toilet base part are connected through a transitional arc surface; and a maximum width of the lower toilet base part is greater than a maximum width of the upper toilet base part.

* * * * *